US007591102B1

(12) United States Patent
Evans

(10) Patent No.: US 7,591,102 B1
(45) Date of Patent: Sep. 22, 2009

(54) EMERGENCY DOOR OPENING ACTUATOR

(76) Inventor: Rob Evans, 7043 W. Carol Ann Way, Peoria, AZ (US) 85382

( * ) Notice: Subject to any disclaimer, the term of this patent is extended or adjusted under 35 U.S.C. 154(b) by 643 days.

(21) Appl. No.: 10/964,041

(22) Filed: Oct. 12, 2004

(51) Int. Cl.
*E05F 15/20* (2006.01)

(52) U.S. Cl. ..... 49/7

(58) Field of Classification Search ..... 49/1, 49/4, 7, 8; 160/1
See application file for complete search history.

(56) References Cited

U.S. PATENT DOCUMENTS

| | | | | |
|---|---|---|---|---|
| 1,449,954 | A | 3/1923 | Radoush | |
| 2,923,226 | A * | 2/1960 | Wasserman et al. | 454/357 |
| 3,399,500 | A * | 9/1968 | Shapiro | 52/1 |
| 3,685,567 | A | 8/1972 | Pemberton et al. | |
| 3,830,016 | A * | 8/1974 | Levine | 49/8 |
| 3,834,076 | A | 9/1974 | Vallee et al. | |
| 4,048,630 | A | 9/1977 | Deming et al. | |
| 4,068,417 | A * | 1/1978 | Anghinetti et al. | 52/1 |
| 4,104,834 | A * | 8/1978 | Anghinetti et al. | 52/1 |
| 4,197,675 | A | 4/1980 | Kelly | |
| 4,338,526 | A | 7/1982 | Martin et al. | |
| 4,365,250 | A | 12/1982 | Matsuoka et al. | |
| 4,464,651 | A | 8/1984 | Duhame | |
| 4,539,555 | A | 9/1985 | Tefka | |
| 4,648,310 | A * | 3/1987 | Wescoat et al. | 454/369 |
| 4,819,551 | A | 4/1989 | Vole | |
| 4,884,832 | A | 12/1989 | Bungard | |
| 4,919,235 | A | 4/1990 | DelSavio | |
| 5,072,973 | A | 12/1991 | Gudgel et al. | |
| 5,245,879 | A | 9/1993 | McKeon | |
| 5,263,527 | A | 11/1993 | Marlatt et al. | |
| 5,482,103 | A | 1/1996 | Burgess et al. | |
| 5,642,092 | A | 6/1997 | Dunne et al. | |
| 5,652,563 | A | 7/1997 | Maus | |
| 5,896,907 | A | 4/1999 | Dever et al. | |
| 6,014,307 | A | 1/2000 | Crimmins | |
| 6,046,562 | A | 4/2000 | Emil | |
| 6,225,768 | B1 | 5/2001 | Cookson et al. | |
| 6,346,889 | B1 | 2/2002 | Moss | |
| 6,425,211 | B1 * | 7/2002 | Wise et al. | 52/1 |
| 6,484,784 | B1 | 11/2002 | Weik, III et al. | |
| 6,503,141 | B2 | 1/2003 | Meneely, Jr. | |
| 6,605,910 | B2 * | 8/2003 | Mullet et al. | 318/264 |
| 6,611,205 | B2 | 8/2003 | Guthrie et al. | |
| 6,653,810 | B2 | 11/2003 | Lo | |
| 6,662,848 | B2 | 12/2003 | Goodman et al. | |
| 6,710,714 | B2 | 3/2004 | Conway | |
| 6,737,821 | B1 | 5/2004 | Fitzgibbon et al. | |

(Continued)

*Primary Examiner*—Jerry Redman
(74) *Attorney, Agent, or Firm*—Schmeiser Olsen & Watts LLP

(57) ABSTRACT

An emergency door opening actuator includes electrical switches that are at least one of normally open and normally closed. The electrical switches may be connected accordingly in parallel or in series to terminals of an overhead door operator. The terminals may correspond to a push button circuit, an obstruction sensing circuit, an alarm system circuit, and/or a door opening circuit. The emergency door opening actuator may take advantage of a protocol in the operator to cause the overhead door to open during an emergency condition to facilitate egress. Likewise, the emergency door opening actuator may cause that the overhead door cannot close by signaling the protocol in a predetermined way when the switches are actuated by an emergency condition. The electrical switches may be mechanically actuated when at least one fusible link is broken.

6 Claims, 2 Drawing Sheets

U.S. PATENT DOCUMENTS

| | | | |
|---|---|---|---|
| 6,771,181 | B1 | 8/2004 | Hughen, Jr. |
| 2002/0183008 | A1 | 12/2002 | Menard et al. |
| 2004/0142654 | A1 | 7/2004 | Stammer et al. |
| 2004/0183677 | A1 | 9/2004 | Fitzgibbon |

* cited by examiner

EMERGENCY DOOR OPENING ACTUATOR

BACKGROUND OF THE INVENTION

1. Technical Field

This invention generally relates to an emergency actuation system for overhead doors, and specifically to an emergency door opening actuator that causes an automatic overhead door to open in case of a fire or associated high temperatures.

2. State of the Art

Fire doors with actuators that cause the doors to close in emergency conditions are known. These fire door systems generally close overhead doors under the influence of gravity. Many such doors have fusible links that melt and break at temperatures above a certain range. These door systems thus have mechanical door closing actuation mechanisms and mechanical closing mechanism. Some fire doors have been developed that have electric powered door closing mechanisms and electronic door closing actuation mechanisms.

Other door systems have been developed for assuring ventilation when a high level of a toxic gas such as carbon monoxide has been detected. Once again, these doors systems include electronic sensors and actuate a door open when a minimum level of carbon monoxide or other gas is detected There is a deficiency of devices for assuring egress from a garage or house through the garage door. Several persons including fire fighters have lost their lives or been severely injured by being trapped in a garage during a fire. These deaths and injuries continue to occur, indicating a need in the art for a simple, inexpensive, yet failsafe device that will cause an overhead door to open and allows egress in the case of a fire.

DISCLOSURE OF THE INVENTION

The present invention relates to emergency door actuation systems for overhead doors in general, and specifically to an emergency door opening actuator that causes an automatic overhead door to open in case of a fire or associated high temperatures.

An emergency door opening actuator in accordance with the present invention may include electrical switches that are at least one of normally open and normally closed. These electrical switches may be connected accordingly in parallel or in series to terminals of an overhead door operator. The terminals may correspond to a push button circuit, an obstruction sensing circuit, and/or an alarm system circuit. The operator may have an existing protocol for responding to signals from a push button circuit and an obstruction sensor circuit. Thus, the emergency door opening actuator may take advantage of the protocol to cause the overhead door to open during an emergency condition to facilitate egress. Likewise, the emergency door opening actuator may cause that the overhead door cannot close. This is achieved by signaling the protocol in a predetermined way when the switches are actuated by an emergency condition. The electrical switches may be mechanically actuated when at least one fusible link is broken.

In a simple form, an emergency door opening actuator may include a switch actuator movable between a first position and a second actuation position. The switch actuator may engage an electrical switch in the first position. The switch actuator may be coupled to at least one fusible link. The switch actuator may also be coupled to an anchor that is adapted for mounting to a structural member of a building/house. The fusible link may be configured such that when it breaks, the switch actuator moves to its second position and releases the electrical switch.

The fusible link may be one of a plurality of fusible links. The door opening actuator may further include a sash that includes the fusible link and couples the switch actuator to the anchor. The plurality of fusible links may be located at key locations in the building/house for release of the sash during fires or high heat in the key locations.

The emergency door opening actuator may include a housing that supports one or more of the switch, the switch actuator, and a spring. The housing may have a mounting structure thereon adapted for attachment of the housing on a structural member proximate to an automatic door operator.

In another simple form, the present invention may include a method of causing an overhead door to automatically open during an emergency. The method may include mechanically coupling a switch actuator to at least one fusible link, and connecting at least one electrical switch to at least one terminal of an automatic door operator to transmit an indication to the operator similar to that which is received from a button circuit when an automatic door operator button is pressed. This aspect of the invention may also provide one or more aspects of a method of installing and/or a method of manufacturing. The method of causing the overhead door to automatically open may include engaging the electrical switch with the switch actuator in a non-emergency state. The method may also include disengaging the switch actuator from the switch and releasing the electrical switch when the fusible link is broken by a predetermined temperature. As may be appreciated, the method may include connecting a plurality of switches to a plurality of terminals in the automatic door operator to transmit indications similar to one or more of an indication that the button has been pressed, that an obstruction has been detected, that an alarm condition exists, and that the door must be raised.

The method of causing the overhead door to automatically open wherein the fusible link is integral with the sash may include anchoring a distal end of the sash to a point in a building/house, connecting a proximal end of the sash to the switch actuator, and holding the switch actuator in a non-emergency position against a bias of the switch actuator. The method of causing the overhead door to automatically open may include distributing a plurality of fusible links at selected positions on the sash for response to high temperatures at the selected positions in the building/house. In one case the method may include locating a first of the fusible links proximate the operator and locating a second of the links on an opposite side of a wall from the operator. The method may also include locating at least one of the fusible links at a remote location within the building/house.

In another simple form, the present invention may include an emergency door opening operator having an overhead door operator for raising and lowering an overhead door. A switch actuator may be movable between a first position and a second actuation position in the actuator. The switch actuator may engage an electrical switch in the first position. The switch actuator may be coupled to at least one fusible link as described above. The switch actuator may be coupled to an anchor that is adapted for mounting to a structural member of a building/house. In this way, the electrical switch may be connected to at least one terminal of the overhead door operator. Furthermore, the fusible link may be configured such that when it breaks, the switch actuator moves to its second position and releases the electrical switch.

The at least one terminal may be one of a plurality of terminals connected to a plurality of indication circuits in the overhead door operator. The electrical switch may be one of a plurality of electrical switches that are connected to the plurality of terminals of the operator. The fusible link may be configured such that when it breaks, the switch actuator moves to its second position and releases the plurality of electrical switches.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to emergency actuation systems for overhead doors in general, and specifically to an emergency door opening actuator that causes a door to open in case of a fire or associated high temperatures.

Figure 1:
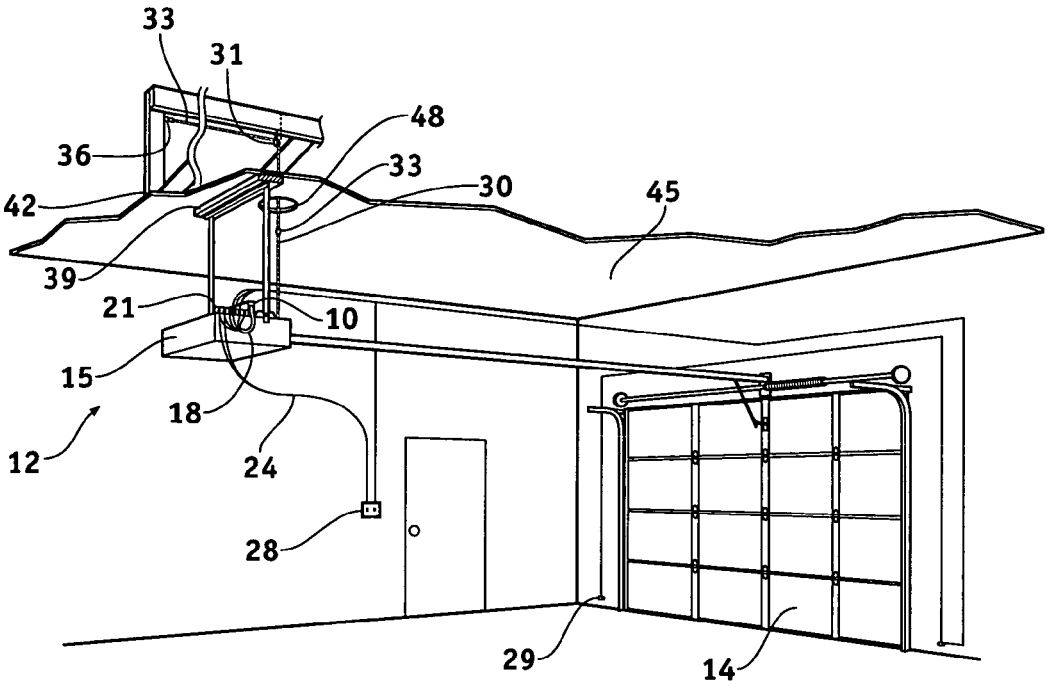
FIG. 1 is a perspective view of an emergency door opening actuator incorporated with an operator and overhead door system according to an embodiment of the present invention.

FIG. 1 shows an emergency door opening actuator 10 incorporated with an automatic door opening system 12 for causing a door 14 to be opened in case of a fire. The door opening actuator 10 may be mounted to an operator 15 of the automatic door opening system 12 or to proximal structural members that are part of or connected to a building in which the door opening actuator is to be used. It is to be understood that references to building herein include residential homes.

As shown, at least one line 18 may extend from the door opening actuator 10 and be connected to a terminal strip 21 to which the push button circuit 24 and the obstruction circuit 27 may also be connected. As may be appreciated, the push button circuit 24 connects the operator 15 to the push button 28 that may be pressed by a user of the automatic overhead door system 12 in a conventional manner. Furthermore, the obstruction circuit 27 includes an optical sensor 29 for detection of an obstruction in a conventional manner. The connections of the line 18 to the terminal 21 may be advantageously made to effectuate the functions of the present invention as will be described in greater detail below.

A sash 30 may couple the door opening operator 10 to one or more fusible links 33 that help make up the sash 30. The sash 30 is also for the purpose of coupling the door opening actuator 21 to an anchor 36. It is to be understood that the sash 30 may be any one of a number of flexible elements such as, rope, wire, cable, or chain. The sash 30 may include rigid linkages that may be formed of rods, channel members, bars, posts, or levers. The sash may also include one or more tension adjusting mechanisms and removable links. The sash may include any combination of the above described elements.

The operator 15 and the door opening actuator may be suspended from exposed rafters 39, or rafters 42 enclosed behind a drywall ceiling 45 in a known manner. The sash 30 may be extended through an opening 48 in the drywall ceiling. Furthermore, the sash 30 may be extended through any number of walls through out the building and may be routed around corners by rollers 31 or eye bolts to enable selective placement of additional fusible links 33 at any location throughout the building. Thus, the sash 30 will be released when a fire or associated high temperatures are experienced at any of the locations.

Figure 2:
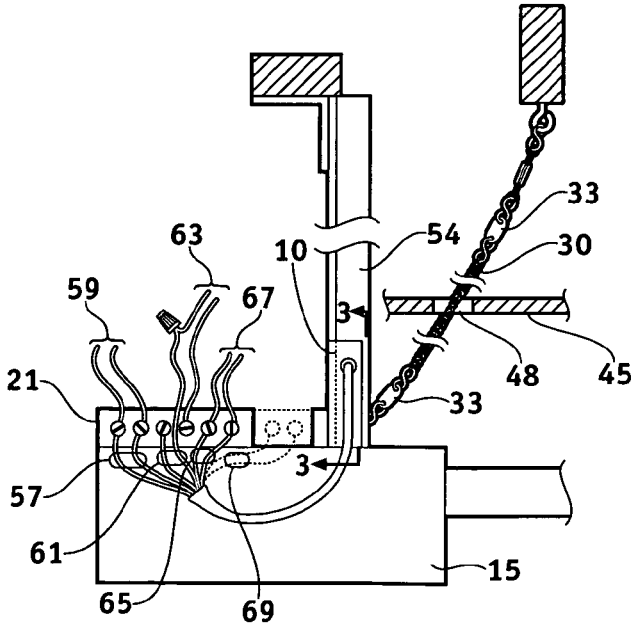
FIG. 2 is a side view of the operator and the emergency door opening actuator of FIG. 1.

FIG. 2 is a side view of the operator 15 and door opening actuator 10 of FIG. 1. As shown, the operator may have a mounting flange 51 fastened to one or more suspension member 54, or may be mounted in any conventional manner. The door opening actuator 10 may also be mounted to the mounting flange 51. The door opening actuator 10 may be at least partially supported in an attractive housing that may be powder coated with a fire resistant paint. The door opening actuator 10 may thus become substantially integral with the operator 15 and the overall door opening system 12. In fact, the door opening actuator may be incorporated directly within the operator housing and may be made part of an operator by a manufacturer. This is due, in part, to the door opening actuator's complete compatibility with the operators available on the market today.

The terminal strip 21 may be exposed or may be enclosed in the operator 15. Thus, the terminal strip 21 is shown in a manner that may be considered schematic in FIG. 2. The line 18 may include a sheath that encloses a plurality of wire pairs that may be connected to the terminals of the terminal strip 21. A first pair of wires 57 may be connected in series to a pair of wires 59 forming the push button circuit 24 when the push button circuit is a normally closed circuit. (A series connection with the obstruction sensor circuit 27 is shown in FIG. 2.) Alternatively, the first pair of wires 57 may be connected in parallel to a pair of wires 59 forming the push button circuit 24 as shown by connections at the two left most terminals in FIG. 2 when the push button circuit 24 normally operates as an open circuit. A second pair of wires 61 may be connected in series with a pair of wires 63 forming the obstruction sensor circuit 27 since the obstruction sensor circuit 27 normally operates as a closed circuit. It is to be understood that series or parallel connections may be applied depending on whether the circuit to which the respective switches are to be connected normally operate as closed or opened circuits. As such, a third pair of wires 65 may be connected in series or parallel with a pair of wires 67 forming an alarm circuit. Another pair of wires 69 may be provided in additional to or in substitution of the other pairs. The pair of wires 69 may be connected to terminals that are connected to logic and/or protocol configured specifically for preferentially sending a door 14 open in the case of an emergency. This logic and/or protocol may be provided in the operator by the manufacturer similar to the protocols for each of the other circuits to which the other terminals are connected. That is, the terminals shown in dashed lines in FIG. 2 may be a pair of terminals dedicated to the safety function of the present invention. Thus, in the event that a manufacturer wishes to implement the advantages of the present invention directly into a particular operator, doing so may be accomplished by including the door opening protocol and an internal or external connection analogous to the terminals shown in dashed lines for connection to wires analogous to wires 69 connected to a door opening actuator. This may be done in addition to (for reduncancy), or in place of the rest of a door opening actuator analogous to door opening actuator 10 that is to be connected to the other terminals and to the other circuits including the push button circuit 24 and the obstruction sensor circuit 27.

Figure 3:
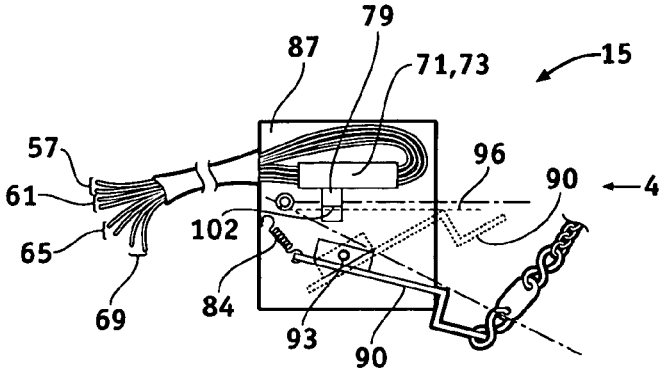
FIG. 3 is a sectional view of the emergency door opening actuator taken along line 3-3 of FIG. 2.
Figure 4:
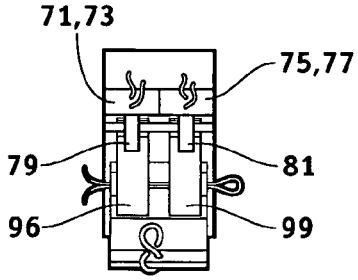
FIG. 4 is an end view taken in a direction of arrow 4 of FIG. 3.
Figure 5:
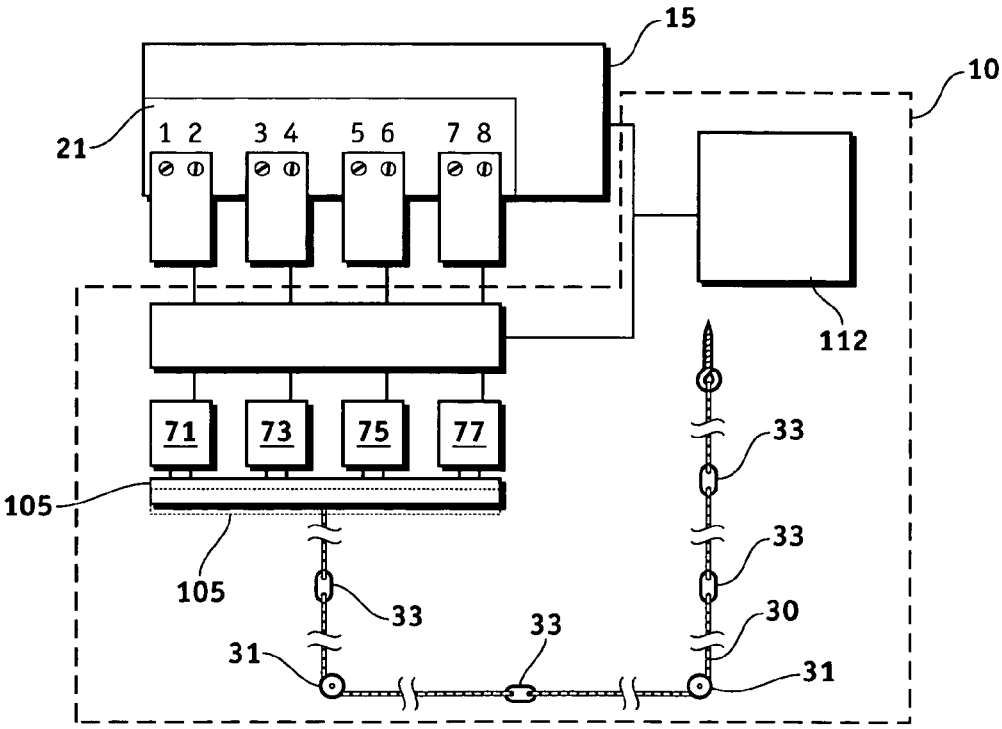
FIG. 5 is a diagrammatic view of the emergency door opening acutator and operator configured according to an embodiment of the present invention.

The pairs of wires 57, 61, 65, and 69 are connected to respective electrical switches 71, 73, 75, and 77 shown in FIGS. 3-5. The switches may have two switches housed together as shown in FIGS. 3 and 4. In this case, pressing button 79 actuates both switches 71 and 73 simultaneously. Pressing button 81 may actuate both switches 75 and 77 simultaneously. As shown, a spring 84 may be secured to a housing 87 and to a switch actuator 90 for biasing the switch actuator toward a position in which it does not engage the buttons 79 and 81. On the other hand, the switch actuator could take any of a number of forms and may be moved into its non engaging condition by any of a variety of biasing mechanisms including under the force of gravity. While FIGS. 3 and 4 depict the switch actuator as including an actuation lever 90 that is pivoted on a pin 93, the switch actuator may alternatively take the form of a plunger or other movable mechanism that is capable of moving between two positions. FIGS. 3 and 4 also show intermediate spring levers 96 and 99 that are moved by the actuation lever 90 and engage the buttons 79 and 81 in a resilient manner. These spring levers 96 and 99 thus have the advantage of protecting the switches 71, 73, 75, and 77 against forces from a rigid switch actuator that may be too great and cause damage. As may be appreciated, the actuation lever 90 and the spring levers 96 and 99 of the exemplary embodiment of FIGS. 3 and 4 work in concert and together provide the switch actuator.

During installation of the door opening actuator 10, the sash 90 must be pulled so that the actuator lever 90 is a first position indicated by the actuation lever 90 shown in dashed lines in FIG. 3. The sash is anchored and tensioned as desired. The spring levers 96, 99 in this position resiliently press the buttons 79 and 81 into their depressed position shown at 102.

In one example, the switch 71 is normally closed when not pressed. However, in the embodiment of FIGS. 3 and 4, the initial position for operation of the door opening actuator 10 is with the button 71 pressed. Thus, during use, switch 71 is held in the open position. Therefore, when a fusible link breaks, the actuation lever is released and is biased into its normally closed position. Button 79 is disengaged by the actuation lever 90 and the spring lever 96 so that the first switch 71 moves into its closed condition. As may be appreciated, the series connection of the first pair of wires 57 from the first switch 71 to the first pair of terminals and the push button circuit 24 will actuate door 14 as though the push button 28 had been pressed when the circuit 24 is a normally closed circuit. Alternatively, a parallel connection of first pair of wires 57 from the first switch 71 to the first pair of terminals and the push button circuit 24 will actuate the door 14 as though the push button 28 had been pressed when the circuit 24 is a normally open circuit. Thus, if the door 14 is originally closed when a fusible link breaks, the door 14 will be caused to go up by the closure of switch 71 under the same protocol as for operation of the door by the push button 28. At the same time, the second switch 73 is normally open when the button is not engaged so that during operation with the button 79 pressed, the second switch is held closed. When the fusible link breaks, the actuation lever 90 is released and the second switch is moved to the open condition. This may send a signal to the operator akin to that received when an obstruction is detected by the sensor 29. Since the door 14 is closed or already going up, the protocol may do nothing to change the action by the operator as under similar conditions with an obstruction detected by the sensor 29. Alternatively, the protocol may completely interrupt wiring to the sensor to prevent the door from closing.

As shown in FIG. 2, the second switch 73 may be connected in series by the second pair of wires 61 from the door opening actuator 10 with the pair of wires from the obstruction circuit 27. This is advantageous because the obstruction circuit operates as a normally closed circuit and is opened when an obstruction is detected. Therefore, holding the second switch 73 in the closed condition absent a fire enables the second switch to function properly when placed in series with the obstruction circuit. In this configuration, it can be appreciated that as soon as a fusible link is broken, the emergency door opening actuator will open the circuit formed in series with the obstruction sensing circuit 27 and the door 14 cannot close.

In the case of the door 14 being already open, actuation of the door opening actuator 10 when a fusible link breaks will cause the first switch to close, which will start closing the door. However, the second switch will be opened causing the door 14 to either stop of reverse and go up in accordance with the protocol in the operator 15 for the case in which the door 14 is descending and an obstruction is sensed. Similarly, if the door 14 is stopped between a completely opened and a completely closed condition, then either the first switch will send the door 14 up or the second switch will send the door up in accordance with the existing protocols in the operator 15. Once again, with the series circuit formed with the obstruction sensing circuit open, the door 14 cannot close.

The third switch 75 may be connected to the fifth and sixth terminals by the third set of wires 65 in systems 12 that have a protocol for connection with an alarm system. Depending on whether the configuration of the alarm system operates as normally closed or normally opened, the third set of wires 65 may be connected in series as shown or in parallel. The third pair of wires 65 may thus send a signal that actuates the alarm system when a fusible link breaks and the switch actuator is released.

The fourth switch 77 may be connected to a seventh and eighth terminal by a fourth pair of wires 69 as a fail safe measure for sending the door 14 up if the first and second switches 71 and 73 fail to cause the door 14 to go up, in a case of a burned switch or wires. Alternatively, the fourth switch may replace the function described above with regard to the first and second switches 71 and 73 by causing the door 14 to go up when a fusible link breaks and the fourth switch is actuated. A protocol may be provided in the operator to respond to such a signal and preferentially open the door 14 under such emergency conditions.

It is to be understood that while a specific example has been shown and described herein, the same function may be achieved by a different combination of parallel and/or series connections without departing from the spirit and scope of the invention. For example if the push button circuit 24 were to operate in a normally closed condition so that opening the circuit 24 actuates the door 14, then a parallel connection of the first pair of wires would have to be replaced by a series connection. Similarly, the switches need not be initially held in a condition opposite from their at rest condition. The circuitry may be adjusted to accommodate such modifications.

FIG. 5 is a diagrammatic view of the operator 15 and the door opening actuator 10. As shown, the terminal strip 21 may include first through eighth terminals, which may be connected to the first through the fourth switches 71, 73, 75, and 77. In this diagram, the switches are shown as separately housed switches that have respective buttons. A switch actuator 105 may be moved between an engaging and a non-engaging position as shown in solid and dashed lines. This switch actuator 105 may be a combination of levers 90, 96, and 99, or may be a single member. The switch actuator 105 may be coupled to one or more fusible links 33. The switch actuator may also be coupled by the sash 30 to the anchor 36.

For engagement in a structural member of the building in which the door opening actuator is to be installed.

As indicated by the plurality of fusible links 33, the plurality of guide rollers 31, the sash may be routed to any location within the building, and may be used to selectively distribute fusible links throughout the building. For example, a first fusible link 33 may be located proximate to the operator 15. A second fusible link may be located on an opposite side of a wall such as the drywall ceiling 45 for response to a fire or associated heat that may be temporarily isolated to a volume within the attic. Other locations in the attic may be monitored similarly by a long sash that may extend to remote positions in the attic as shown in FIG. 1. Thus, if any of the fusible links breaks, then the door opening actuator will be actuated and will in turn cause the operator 15 to raise the associated overhead door 14.

FIG. 5 also include a timing device 108 that may be operably connected to the switches 71, 73, 75, and 77. This timing device may be desirable in some circumstances in order to delay the opening of the door 14. For example, the timing device could delay causing actuation of the door for approximately five to ten minutes so that the fire may be isolated for the short period of time between notification of the fire department and their arrival. This may be beneficial for buildings that have an alarm system that automatically notifies the fire department. However, the safety issues of a need for egress will usually override any advantage that a timing device may provide.

The door raising actuator 10 may also include a backup power supply 112 that may be connected to the operator and/or time delay device 108. The battery backup may include one or more batteries and may have sufficient power to raise the door completely and actuate any alarms.

Several advantages are provided by the present invention. Of greatest importance, an escape route may be provided by actuation of the door caused by the emergency door opening actuator 10 of the present invention. Furthermore, entry through the garage door is one of the second most preferred modes of entry for fire fighters attempting to enter a burning house. With the present invention, the garage door will be automatically opened. Therefore, entry therethrough may be facilitated and may become the preferred mode of entry. Other advantages of the present invention may include the fact that opening the garage in accordance with the present invention may draw the fire away from other parts of the home and into the garage by feeding oxygen to the fire at the garage door.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. For example, while the present invention has been shown and described as formed of micro-switches and relatively large switch actuators that engage the switches, analogous circuitry may be incorporated on a circuit board or as a microcircuit. Additionally, while the present invention has been shown and described with regard to opening an overhead door in an emergency, the same principles could be used for closing doors in case of emergencies. Doing this is desirable in some applications similar to fire door applications in which isolation of a fire is the goal. In this regard, the present invention has application in residential garage doors and commercial applications for both opening and closing overhead doors.

The invention claimed is:

1. A door opening system operatively coupled to a door of a building, the system comprising:

a door switch which opens and closes the door;

an obstruction sensing switch operatively coupled to the door, the obstruction sensing switch opening the door in response to an indication of an obstruction;

a switch actuator operatively coupled with the door switch and obstruction sensing switches, the switch actuator being repeatably moveable between first and second positions, wherein the switch actuator deactivates the door and obstruction sensing switches in response to being in the second position; and a fusible link coupled to the switch actuator and the building with a sash, wherein the switch actuator moves from the first position to the second position in response to the fusible link breaking.

2. The system of claim 1, wherein the door and obstruction sensing switches are capable of controlling the operation of the door when the switch actuator is in the first position.

3. The system of claim 1, wherein the door and obstruction sensing switches are restricted from controlling the operation of the door when the switch actuator is in the second position.

4. The system of claim 1, wherein the door is restricted from closing when the switch actuator is in the second position.

5. The system of claim 1, wherein the door is restricted from closing when the switch actuator is moved from the first position to the second position.

6. The system of claim 1, wherein the door is moved to an open position in response to the switch actuator being moved to the second position.

* * * * *